US005542519A

United States Patent [19]

Weston et al.

[11] Patent Number: 5,542,519

[45] Date of Patent: Aug. 6, 1996

[54] METHOD AND APPARATUS FOR CONTROLLING THE DISPENSING OF MONEY

[75] Inventors: John A. Weston, Reading; Anthony D. Johnson, Wokingham, both of United Kingdom

[73] Assignee: Mars Incorporated, McLean, Va.

[21] Appl. No.: 374,654

[22] PCT Filed: Jul. 30, 1993

[86] PCT No.: PCT/GB93/01623

§ 371 Date: Jan. 27, 1995

§ 102(e) Date: Jan. 27, 1995

[87] PCT Pub. No.: WO94/03875

PCT Pub. Date: Feb. 17, 1994

[30] Foreign Application Priority Data

Jul. 30, 1992 [GB] United Kingdom ..... 9216205

[51] Int. Cl.[6] ..... G07D 1/06

[52] U.S. Cl. ..... 194/217; 453/20

[58] Field of Search ..... 194/216, 217, 194/218; 453/17, 20

[56] References Cited

U.S. PATENT DOCUMENTS

| | | | |
|---|---|---|---|
| 4,192,972 | 3/1980 | Bertoglio et al. . | |
| 4,462,512 | 7/1984 | Schuller | 194/217 |
| 4,706,202 | 11/1987 | Kobayashi et al. | 194/217 |
| 4,967,896 | 11/1990 | Hara | 194/217 |
| 5,197,588 | 3/1993 | Furuya et al. | 453/17 X |

FOREIGN PATENT DOCUMENTS

| | | |
|---|---|---|
| 0151761 | 8/1985 | European Pat. Off. . |
| 0305290 | 3/1989 | European Pat. Off. . |
| 2247340 | 4/1974 | Germany . |
| 4101949 | 7/1992 | Germany . |
| 2140954 | 12/1984 | United Kingdom . |

OTHER PUBLICATIONS

Patent Abstracts of Japan, vol. 14, No. 163, (JP 202 0952; Tamura Electric Works Ltd.) 24 Jan. 1990 (1 page of Abstract).

*Primary Examiner*—F. J. Bartuska
*Attorney, Agent, or Firm*—Fish & Richardson, P.C.

[57] ABSTRACT

A method of calculating a combination of coins to be dispensed as change comprises evaluating different possible combinations and selecting the most favorable one. One combination is determined according to priority, giving higher priority to higher-denomination coins. In other combinations, the number of coins of one or more denominations is one less than would be determined by priority.

25 Claims, 3 Drawing Sheets

METHOD AND APPARATUS FOR CONTROLLING THE DISPENSING OF MONEY

FIELD OF THE INVENTION

This invention relates to a method of, and an apparatus for, controlling the dispensing of money in the form of units having a plurality of denominations. The invention is particularly, but not exclusively, applicable to machines such as vending machines which receive coins of a plurality of denominations, and which have a plurality of stores each containing coins of a respective denomination, and each possibly being capable of being replenished by insertion of coins into the vending machine. Means are provided for dispensing coins from the stores in an amount which corresponds to the difference between the amount inserted, and the value of the vend or vends performed by the machine.

The invention is not limited to such arrangements. The dispensed monetary units could be, for example, banknotes, or a mixture of banknotes and coins. The invention also has wider applicability than vending machines; it may be applied to change-giving machines of any type.

BACKGROUND OF THE INVENTION

In the field of vending machines, it is well known to use a dispensing control means which calculates a preferred combination of coins for dispensing in the form of change. One typical way of achieving this, referred to as the "least number of coins" method, involves determining the total amount of change to be dispensed, calculating the maximum number of coins of the highest available denomination which in total have a value of equal to or less than the amount to be dispensed, deducting this amount to obtain a residual amount to be dispensed, taking the next lower denomination and determining the maximum number of coins which in total are equal to or less than this residual amount, deducting this total from the residual amount, and continuing using progressively smaller denominations until either the residual amount is equal to zero or the lowest denomination has been used. The object of this technique is to use as many higher-denomination coins as possible, so that the total number of dispensed coins is minimised. This maximises the number of coins retained in the stores so that change remains available for the maximum number of transactions.

It is important that the calculation of the combination of coins to be dispensed takes place quickly, so as not unduly to delay the user of the machine. In the past, this calculation has taken place at the same time as the dispensing. Thus, the highest value coins would be dispensed in turn, until the remaining amount to be dispensed became less than a single coin of this denomination. Then the next lower denomination would be dispensed in a similar manner. With such an approach, if insufficient coins of a low denomination are available, the user will be short-changed. In some machines, the user is given a warning of this possibility so that he can avoid using the machine, or so that he can select a vend price and/or the nature of the inserted coins in such a manner as to minimise the requirement for change. These warnings would be given in response to detecting a low level of availability of coins of the lowest denomination. For the warning to be reliable, the threshold level at which the warning was given was set to be considerably higher than would often be necessary, depending on the availability of higher-denomination coins. Accordingly, this warning was given unnecessary frequently.

In some known arrangements, the combination of coins to be dispensed is calculated before any coins are dispensed. This makes it possible with greater reliability to assess those situations in which insufficient coins are available to give the correct amount of change. However, these arrangements still suffer from a number of disadvantages. First, the method used to calculate the number of coins of various denominations did not always correctly give the combination which uses the least number of coins. This could happen even if coins of all the denominations handled by the machine were available. However, it would happen more frequently if certain of these coins were unavailable because the relevant stores had been depleted or because the mechanism for dispensing from those stores had malfunctioned. Second, the warning that sufficient change was unavailable would be given in circumstances when the correct amount of change could be provided by a different combination of coins.

U.S. Pat. No. 4,192,972 shows an arrangement which determines different combinations of coins (or other monetary units) deposited during the current transaction which can be dispensed as change, until there is determined a combination having a total value equal to the amount desired to be dispensed. However, this arrangement would often suffer from the first disadvantage mentioned in the preceding paragraph. Also, the technique used for determining the different combinations is unsuitable for minimizing the number of required calculations.

It would therefore be desirable to provide a technique for overcoming these problems.

SUMMARY OF THE INVENTION

According to one aspect of the present invention there is provided a method of controlling the dispensing of money in the form of units having a plurality of denominations, the method comprising:

(i) determining a dispensing amount representing a desired amount to be dispensed;

(ii) evaluating different combinations of monetary units which in total substantially correspond to the dispensing amount; and (iii) using the evaluations to select one of said combinations for use when dispensing the coins;

wherein one combination is formed by giving priority to units in order of denomination, with the highest denomination having the highest priority, and a further combination is formed using the same priority except that the number of units of one denomination, which is higher than the lowest denomination, is equal to one less than that determined according to priority.

According to another aspect of the present invention there is provided a method of controlling the dispensing of money in the form of units having a plurality of denominations, the method comprising:

(i) determining a dispensing amount representing a desired amount to be dispensed;

(ii) evaluating different combinations of monetary units which in total substantially correspond to the dispensing amount; and (iii) using the evaluations to select one of said combinations for use when dispensing the coins;

wherein the selected combination is selected from combinations in which the number of units of each denomination is determined according to priority, the priority being allocated in order of denomination with the highest denomination having the highest priority, or in which the number of units of at least one of the denominations (excluding the lowest denomination) is one less than that determined according to priority in which case lower denomination units are then allocated according to priority or (except for the lowest denomination) one less than determined by priority.

The invention also extends to apparatus arranged to operate in accordance with either of these aspects of the invention.

In the preferred embodiment of the invention, the dispensing of monetary units is controlled according to an algorithm which, as in prior art arrangements, calculates a combination of coins (which may comprise the least number of coins necessary to give the correct amount of change) by allocating priority to higher-denomination coins. However, other combinations are also calculated, and a selection is made between the different combinations. These further combinations are calculated in a similar way, except that the number of units of at least one denomination is one less than would be determined according to priority. The number of units of the smaller denominations are then determined according to priority, or again are equal to one less than determined by priority. The additional amount of processing time required to perform these additional calculations of different combinations is small, because there is a small number of additional calculations. In the preferred embodiment, for each of the denominations which is higher than the lowest denomination, it is possible for there to be a set of combinations in which that denomination has one unit less than determined according to priority and in which each of the other denominations has a number of units equal to that determined by priority or one less than determined according to priority. Thus, for a four denomination arrangement, each of the three higher denominations may be combined in an amount equal to that determined by priority or one less than that amount, so that the total number of combinations is equal to $2^3=8$. This is the maximum number of combinations, because some may not be possible because the denomination is unavailable, or because the number of coins determined by priority is zero and therefore it is not possible to try a combination which is less than this number.

It has been found that, despite the small number of combinations, it is possible using this technique to evaluate the best combination of coins to dispense in a wide range of circumstances. It will dispense a smaller number of coins in some circumstances than the prior art technique which attempts to dispense the least number of coins, even when all coins are available. It is able more reliably to determine the least number of coins required for change when coins are unavailable, which is generally not possible using the prior art technique mentioned above. The processing can be carried out sufficiently quickly that, if during dispensing it is unexpectedly discovered that one of the coins has become unavailable, for example due to a malfunctioning of the apparatus, a recalculation can be performed to determine a different combination without noticeable delay for the user.

One of the reasons the technique is capable of performing so quickly is that combinations are tried which involve either a number of units equal to that determined by priority, or one less than this number, and other values are (in the preferred embodiment) not tried.

It has been found that this gives reliable results in a wide variety of circumstances irrespective of the amount to be dispensed or the number of denominations available, or to a large extent the relative values of the denominations, although it is preferred that a minimum ratio between values of different denominations be two or greater.

BRIEF DESCRIPTION OF THE DRAWINGS

An arrangement embodying the invention will now be described by way of example with reference to the accompanying drawings, in which.

DETAILED DESCRIPTION

Figure 1:
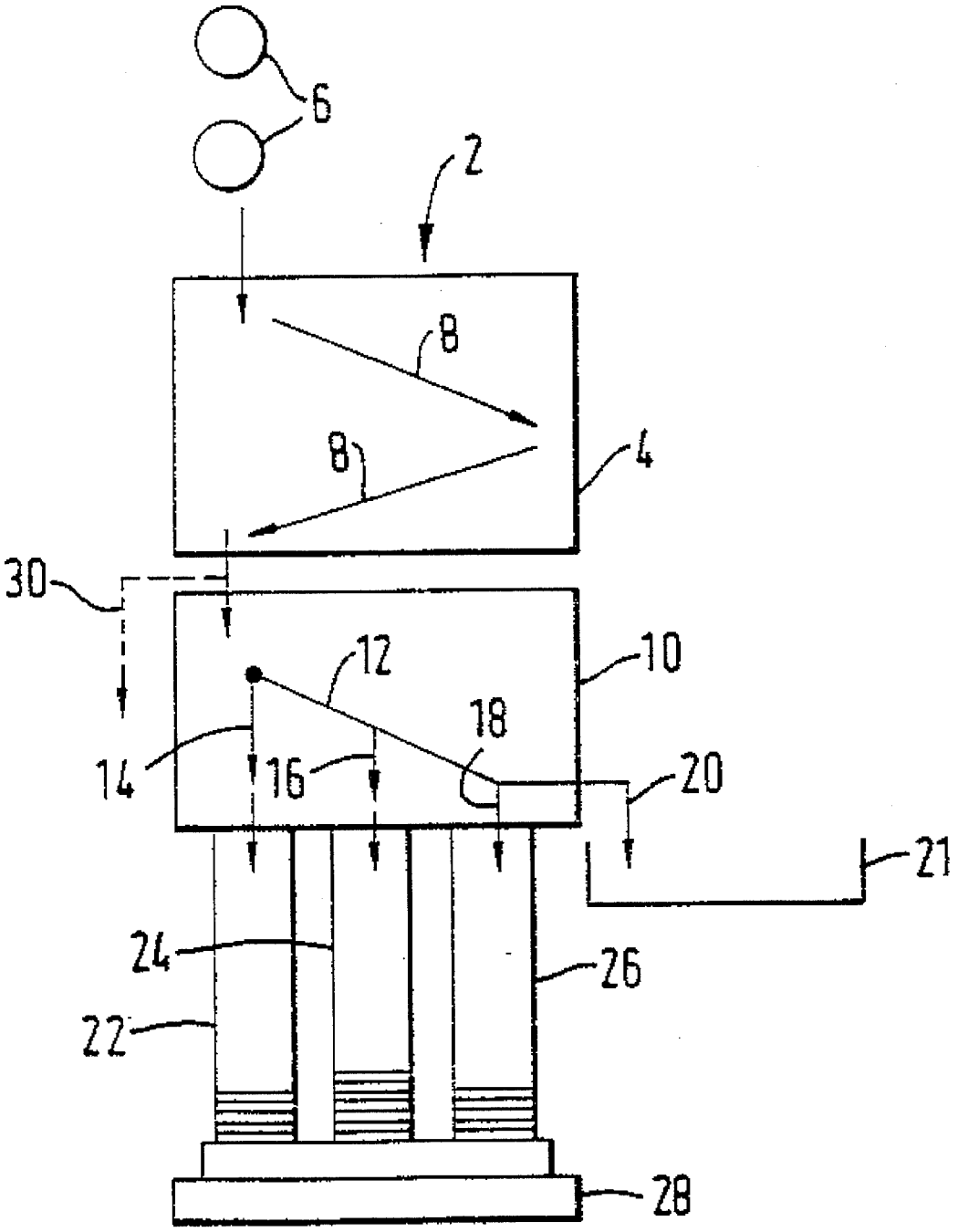
FIG. 1 is a schematic diagram of the mechanical part of a coin handling apparatus in accordance with the invention.

Referring to FIG. 1, the coin handling apparatus 2 includes a coin validator 4 for receiving coins as indicated at 6. During the passage of the coins 6 along a path 8 in the validator 4, the validator provides signals indicating whether the coins are acceptable, and if so the denomination of the coins.

Acceptable coins then enter a coin separator 10, which has a number of gates (not shown) controlled by the circuitry of the apparatus for selectively diverting the coins from a main path 12 into any of a number of further paths 14, 16 and 18, or allowing the coins to proceed along the path 12 to a path 20 leading to a cashbox 21. If the coins are unacceptable, instead of entering the separator 10 they are led straight to a reject slot via a path 30.

Each of the paths 14, 16 and 18 leads to a respective one of three coin tubes or containers 22, 24 and 26. Each of these containers is arranged to store a vertical stack of coins of a particular denomination. Although only three containers are shown, any number may be provided.

A dispenser indicated schematically at 28 is operable to dispense coins from the containers when change is to be given by the apparatus.

Figure 2:
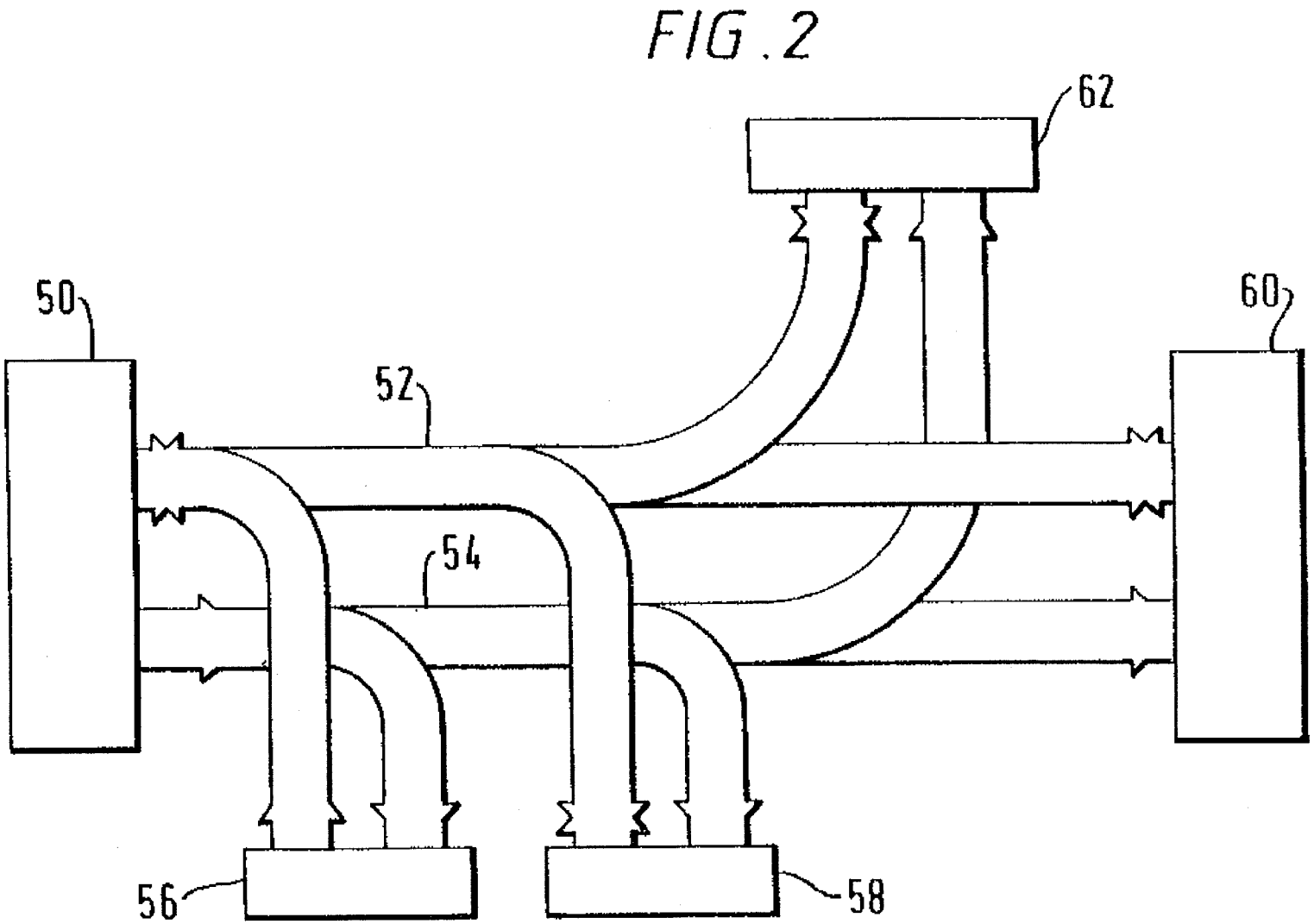
FIG. 2 is a block diagram of the circuit of the coin handling apparatus.

Referring to FIG. 2, the circuit of the present embodiment of the invention incorporates a microprocessor 50 connected to data and address buses 52 and 54. Although separate buses are shown, data and address signals could instead be multiplexed on a single bus. A bus for control signals could also be provided.

The microprocessor 50 is connected via the buses 52 and 54 to a read-only memory (ROM) 56 and a random access memory (RAM) 58. The ROM 56 stores the program controlling the overall operation of the microprocessor 50, and the RAM 58 is used by the microprocessor 50 as a scratch-pad memory.

The microprocessor 50, the ROM 56 and the RAM 58 are, in the preferred embodiment, combined on a single integrated circuit.

The microprocessor 50 may also be connected via the buses 52 and 54 to an EAROM 60 for storing a variety of alterable parameters.

The microprocessor 50 is also coupled via the buses 52 and 54 to input/output circuitry indicated at 62. The circuitry 62 includes at least one level sensor for each of the coin containers 22, 24 and 26, circuits for operating the dispenser 28 and the gates of the coin separator 10, the circuitry of the coin validator 4, and a display visible to a user of the apparatus for displaying an accumulated credit value and an indication when insufficient coins are stored to guarantee that change will be available.

The input/output circuitry 62 also includes an interface between the control circuit of the apparatus and a vending machine to which it is connected.

In operation of the apparatus the microprocessor 50 successively tests the signals from the validator to determine whether a coin has been inserted in the apparatus. When a credit has been accumulated, the microprocessor also tests signals from the vending machine to determine whether a vending operation has been carried out. In response to various signals received by the microprocessor 50, various parts of the program stored in the ROM 56 are carried out. The microprocessor is thus arranged to operate and receive signals from the level sensors of the coin containers 22, 24 and 26, and to control the gates in the separator 10 in order to deliver the coins to the required locations, and is also operable to cause appropriate information to be shown on the displays of the apparatus and to deliver signals to the vending machine to permit or prevent vending operations. The microprocessor is also operable to control the dispenser to deliver appropriate amounts of change.

The arrangement so far is quite conventional, and the details of particular structures suitable for using as various parts of the mechanism will therefore not be described in detail.

The particular sequence of most of the operations carried out by the microprocessor may be the same as in previous apparatus. A suitable program to be stored in the ROM 56 can therefore be designed by anyone familiar with the art, and accordingly only the operations carried out by the particularly relevant parts of this program will be described.

Figure 3:
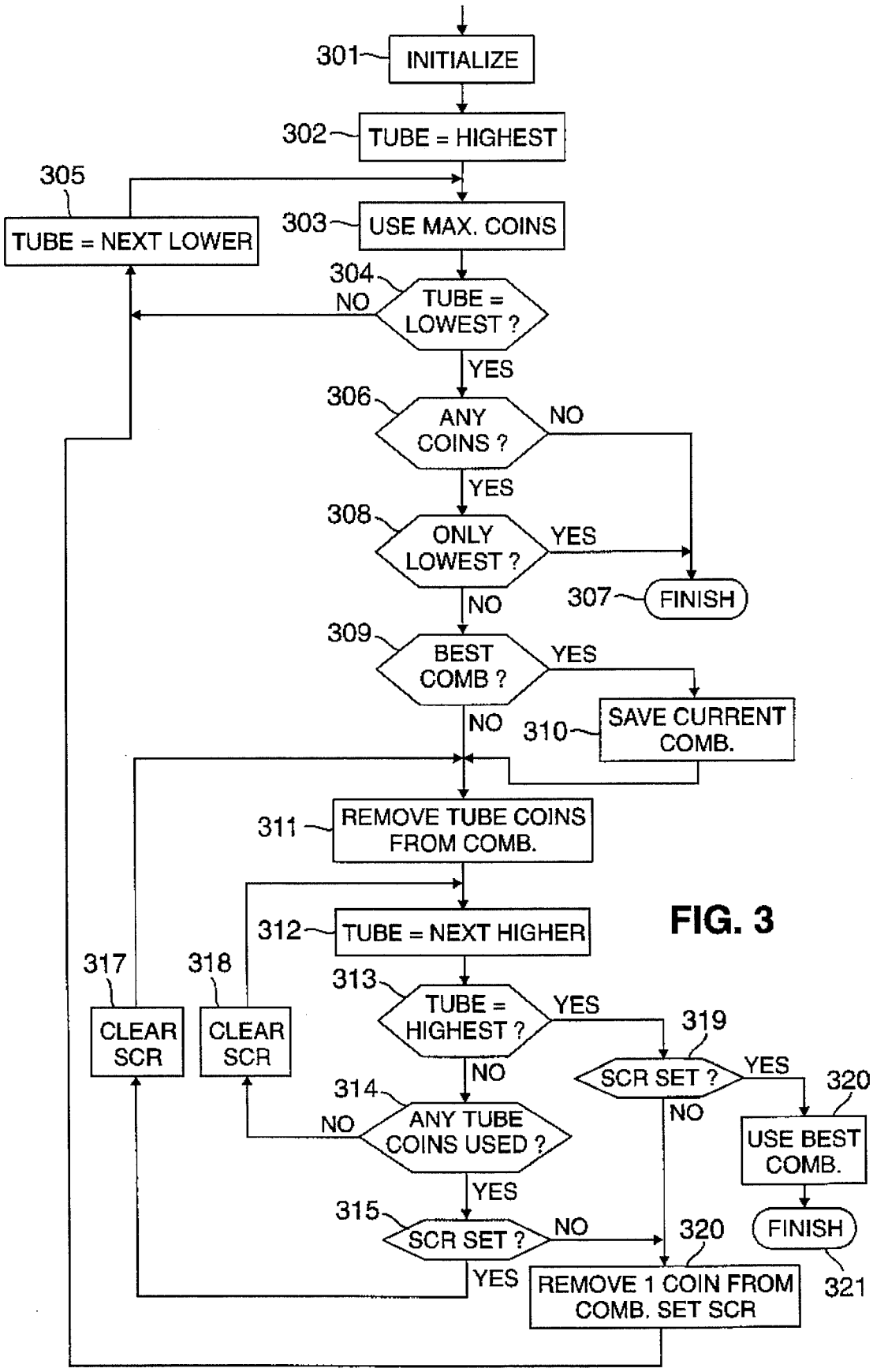
FIG. 3 is a flow chart explaining how the circuit calculates a combination of coins to be paid out as change.

Assuming that money has been inserted into the machine, and a product has been selected for vending, then the microprocessor performs a routine as set out in FIG. 3 to calculate the coins to be dispensed.

At step 301, various variables are initialized, and the amount to be dispensed is set equal to the difference between the amount of cash inserted and the price of the vend. Then, step 302, a variable TUBE is set equal to a number representing the container storing the highest-denomination coins. At step 303, the processor calculates the maximum number of coins from the current TUBE which can be used in the dispensing of change. The total value of these coins must not exceed the amount to be dispensed. The actual number will depend upon the availability of the coins. In the preferred embodiment, the availability of coins in each of the containers is indicated by respective counts, each of which indicates the number of coins in the container. A denomination is considered unavailable (so that coins of this denomination will not be dispensed) when the associated number falls to a predetermined low level (possibly zero). Each count may be recalibrated in response to a level sensor of the associated coin container becoming covered or uncovered as the level of coins changes.

The processor then determines the residual amount to be dispensed, which corresponds to the difference between the amount desired to be dispensed and the total value of the maximum number of coins calculated during step 303.

The processor then proceeds to step 304, in which it determines whether the current TUBE corresponds to the TUBE associated with the lowest denomination. As this point has not yet been reached, the program loops to step 305, wherein the variable TUBE is set to correspond to the container storing the next-lower denomination, and then the program proceeds again to step 303. Here, the processor determines the maximum number of coins of the denomination of the current TUBE which can be used to provide the residual amount to be dispensed.

The program loops through steps 303, 304 and 305 until all denominations have been taken into account, at which time the program proceeds to step 306.

At this time, because the program will have started with the highest denomination and progressively moved to the lowest denomination, each time using as many coins as possible to form the combination to be dispensed, the resulting combination will correspond to that which would be calculated by prior-art arrangements which attempt to produce a combination involving the least number of coins.

Taking a specific example, assuming that the amount to be dispensed was equal to 63 p, that the denominations of available coins are 50 p, 20 p, 2 p and 1 p, and that all such denominations are available in sufficient quantities, then the combination which would have been calculated at this stage would be:

$$(1\times 50\text{ p})+(0\times 20\text{ p})+(6\times 2\text{ p})+(1\times 1\text{ p}) \quad (1)$$

This would therefore require eight coins and would provide an exactly correct amount of change.

The step 306 determines whether the currently-determined combination of coins consists of no coins at all. This would be the case for example if no coins were available. If so, the change calculation routine finishes as indicated at step 307.

Otherwise, the program proceeds to step 308, where it determines whether the current change calculation consists only of coins of the lowest value. If so, then no better combination can be found, and the routine ends at step 307.

Otherwise, the program proceeds to step 309. This step determines whether the current change calculation represents the best change calculation evaluated so far. This would be the case for the first-calculated combination. This would also be the case (a) if the residual dispensing amount, i.e. the difference between the total value of the calculated combination and the desired amount to be dispensed, is less than the residual amount for all previously-calculated combinations, or (b) if the residual amount is no greater than any previously-calculated residual amount, and if the number of coins forming the combination is less than the number of coins of any previously-calculated combinations which give equal residual value.

After step 309, and step 310 if appropriate, the program proceeds to step 311. Here, the program adds to the residual amount the total value of the coins in the current combination which have the denomination associated with the current value of TUBE (which at this stage will be the lowest denomination). The current combination is altered so that these coins no longer form part of that combination.

At step 312, the value of TUBE is set to correspond to the next-higher denomination.

Then, at step 313, the program determines whether the value of TUBE corresponds to that associated with the highest denomination. If not, the program proceeds to step 314. This step checks whether the number of coins in the current combination which have a denomination corresponding to the value of TUBE is greater than zero.

If so, the program proceeds to step 315.

Each of the coin containers has associated therewith a flag, referred to as a single-coin-restored flag SCR. In the initialisation stage 301, all these flags are cleared. At step 315, the program checks to determine whether the flag associated with current TUBE is set. Assuming the flag is still clear, the program proceeds to step 316.

At step 316, the program will add to the residual amount the value of a single monetary unit of the denomination associated with the current TUBE, and will change the current combination to indicate that this unit no longer forms part of that combination. In this situation, the current denomination is referred to herein as a "restore" denomination, because a single monetary unit of this denomination has been taken from the proposed combination and nominally restored to the associated container. Also at step 316, the associated SCR flag is set.

Taking the example given above, at the end of step 316, all the coins of the lowest denomination, 1*p*, would no longer form part of the combination, and a single coin of the next-higher denomination, 2*p*, would no longer form part of the combination. The combination would thus consist of:

$$(1\times 50\ p)+(0\times 20\ p)+(5\times 2\ p)+(0\times 1\ p)$$

and the residual amount would be equal to 3 p.

The program then proceeds to step 305, wherein TUBE is set to correspond to the next-lower denomination, which in this case is the lowest denomination 1 p. The program then uses steps 303 and 304 to complete the calculation of the next combination using the residual amount of 3 p.

After step 304, therefore, the second combination is therefore:

$$(1\times 50\ p)+(0\times 20\ p)+(5\times 2\ p)+(3\times 1\ p) \quad (2)$$

The residual value is therefore zero, i.e. the exact change would be provided, but the total number of coins required would be 9, which is therefore a worse combination than the first.

The program then proceeds to steps 306, 308 and 309. Because this is a worse combination, the program would then proceed straight to step 311. Here, the coins of the lowest denomination are cancelled from the combination and their value added to the residual amount. The program then proceeds to step 312, where TUBE is set to the next-higher denomination (2 p). The program then proceeds through steps 313 and 314 to step 315. Here, it is determined that the associated SCR flag has been set. This indicates that in the last-formed combination, the current denomination was used as a "restore" denomination, i.e. it was set to one less than that determined in accordance with priority (which was carried out at step 316). Accordingly, the program proceeds to step 317, wherein the SCR flag is cleared. Then, the program loops back to step 311.

Because TUBE is now set to correspond to the 2 p denomination, then at step 311 the program changes the current combination by removing therefrom all coins of the current (2 p) denomination. The value of these coins is added to the residual amount.

Then at step 312, TUBE is set to correspond to the next-higher denomination (20 p). The program then proceeds through step 313 to step 314. If at step 314 it is determined that the current combination requires no coins of the current denomination, then the program immediate moves back to step 312, via a step 318 (in which the SCR flag for the current TUBE is cleared) so as to set TUBE to correspond to the next-higher denomination.

At this time, the current TUBE will correspond to the highest-denomination, 50 p. Accordingly, this is determined at step 313 and the program proceeds to step 319. At this step the program determines whether the SCR flag associated with the highest denomination coin is set. Assuming that it is not, the program proceeds to step 316, wherein a single coin of the associated denomination, i.e. 50 p is subtracted from the current combination and its value added to the residual amount. Thus, the highest denomination is now a "restore" denomination. The residual amount would therefore by now be equal to:

$$0+(3\times 1\ p)+(5\times 2\ p)+(1\times 50\ p)=63\ p$$

The SCR flag is then set at step 316, and the program then proceeds to step 305 wherein TUBE is set equal to the next-lower denomination, i.e. 20 p.

The program then loops around steps 303, 304 and 305, in the same way as when the first combination was calculated. The dispensing amount is equal to 63 p, again as for the first combination. However, in this case the program is starting with the 20 p denomination, not the 50 p.

Accordingly, by the time the program reaches step 306, the current combination will be:

$$(0\times 50\ p)+(3\times 20\ p)+(1\times 2\ p)+(1\times 1\ p) \quad (3)$$

Therefore, the residual amount would be zero, and the total number of coins in the combination equal to five.

The program will then proceed to steps 306, 308, 309 and, because this is the best combination calculated so far, to step 310.

By this time, the program would have:

a) calculated a first combination by allocating priorities in accordance with denomination;

b) starting with the next-to-the-lowest denomination (2 p) and ending with the highest denomination (50 p), attempted further combinations in which the number of units of the relevant denomination is one less than determined according to the first combination.

In this case, only two further combinations were evaluated, because no 20 p coins formed part of the first combination.

In a similar way, the program will continue to loop through steps 311 to 317, and then loop round 303 to 305 to form the following fourth combination which is similar to the third combination except that the number of 2 p coins is reduced by one and the number of 1 p coins recalculated accordingly. This results in the following combination:

$$(0\times 50\ p)+(3\times 20\ p)+(0\times 2\ p)+(3\times 1\ p) \quad (4)$$

This produces exact change, but the number of coins is equal to six, which is slightly worse than the third combination.

The program will then reach step 311, and proceed again through the subsequent steps and then back to steps 303 to 305. The result is that this time the number of 20 p coins has been reduced by one as compared with the previous combination, and the lower-denomination coins recalculated accordingly. This results in the following combination:

$$(0\times 50\ p)+(2\times 20\ P)+(11\times 2\ p)+(1\times 1\ p) \quad (5)$$

The total number of coins is thus fourteen, which is worse than the previous combinations.

Thereafter, the program will loop through steps 311 to 315, and then while the value of TUBE corresponds to the 2 p denomination, will proceed to step 316, so that again a further combination is tried in which the number of 2 p coins is set to be one less than the number determined according to priority in the previous combination. As a result, the next combination determined in steps 303 to 305 will be:

$$(0\times 50\ p)+(2\times 20\ p)+(10\times 2\ p)+(3\times 1\ p) \quad (6)$$

This consists of fifteen coins, and therefore is worse than previous combinations.

The program then proceeds to steps 311, 312, 313, etc. When the program reaches step 315, it is determined that the flag for the 2 p denomination has been set so the program will proceed to step 317 and then back to 311 and 312, wherein TUBE is set to correspond to the next-higher denomination, 20 p. When the program then reaches step 315, it is found that this flag has also been set. This is because the program has already tried combinations (combinations 5 and 6) in which the number of coins for this denomination was set to one less than that determined according to priority in an earlier combination.

Accordingly, the program will then proceed to step 317 and then loop back to steps 311 and 312, wherein TUBE is set to the next higher denomination, which in this case is the highest denomination 50 p. This will cause the program to proceed from step 313 to step 319. In this case, the program will determine that the SCR flag for the highest-denomination coin has already been set. This occurred immediately prior to calculating combination 3. Accordingly the program will proceed to step 320 in which the best combination as determined at step 310 is used to set variables which are used in the control of the dispenser. The routine finishes at step 321.

This completes the calculation of the best combination of coins to be dispensed. In this case only six different combinations need to be calculated. It will be noted that the best combination, combination 3, requires significantly fewer coins than the first combination, which is that which would normally be produced by prior art arrangements. In addition, the routine can take into account non-availability of coins.

Furthermore, the routine is designed such that it is not necessary each time to perform a full calculation of all elements of the combination. Instead, by using the step of removing lower-denomination coins from already-calculated combinations, increasing the residual dispense amounts by the total of the reduced number of coins, and then recalculating only the lower-denomination coins of the combination, it is possible to reduce substantially the amount of processing required.

The dispensing operation is monitored, and if at any time the dispenser fails to dispense a coin of the calculated combination, a new dispensing amount is calculated by reducing the original dispensing amount by the total value of the coins so far dispensed, and then executing the routine of FIG. 3 again to calculate a new combination of coins for dispensing the remaining amount.

The above-described routine is capable of calculating different combinations of monetary units which in total are equal to the amount desired to dispense. However, there are likely also to be circumstances in which there is no combination which in total is equal to this amount. In this situation (as indicated with respect to step 309) the routine is capable of comparing combinations which produce totals which are equal to each other but less than the desired amount. The combination involving the least number of coins will be selected for dispensing. Following the execution of the routine, if desired, the microprocessor may be arranged to illuminate a display indicating that insufficient change is available in response to a determination that the best combination produces coins which total less than the desired amount of change. The user may then act by changing the product selected for vending, by selecting a further product or by cancelling the selected product and obtaining a refund of the inserted cash.

It is assumed in the foregoing that higher-denomination coins are preferentially dispensed as compared to lower-denomination coins, subject to the requirement for dispensing an amount which is as close as possible to the desired amount, and dispensing the least number of coins. However, there may be circumstances in which other factors should desirably be taken into account, and these further factors may vary from time to time. For example, it may be desirable to use lower-denomination coins in preference to higher-denomination coins if the number of such lower-denomination coins exceeds a predetermined amount. This may be the case if it is desired to avoid sending an excessive number of lower-denomination coins to the cashbox and thus leaving insufficient room for higher-denomination coins. The algorithm described with reference to FIG. 3 may be easily modified to take account of such factors. For example, the processor may store an indication that a higher-denomination coin is temporarily unavailable when the number of lower-denomination coins is high.

The preferred embodiment described above dispenses money from stores replenished by a serviceman or as a result of a series of transactions carried out by the machine. Alternatively, the invention can be applied to arrangements in which the money is dispensed from a store or stores containing only those monetary units inserted for the current transaction.

We claim:

1. Apparatus for controlling the dispensing of money in the form of units having a plurality of denominations, the apparatus comprising:

(i) dispensing means for determining a dispensing amount representing a desired amount to be dispensed;

(ii) combining means for determining different combinations of monetary units which in total equal the dispensing amount;

(iii) comparison means for comparing said different combinations; and (iv) selection means for selecting one of said combinations for use when dispensing;

wherein one combination is formed by giving priority to units in order of denomination, with the highest denomination having the highest priority, and a further combination is formed using the same priority except that the number of units of one denomination, which is higher than the lowest denomination, is equal to one less than that determined according to priority.

2. Apparatus as claimed in claim 1, wherein a plurality of further combinations are formed, each using the same priority except that in each case the number of units of a respective denomination is one less than determined according to priority.

3. Apparatus as claimed in claim 2, the apparatus being operable to determine further combinations in each of which the number of units of each of a plurality of denominations is one less than determined according to priority.

4. Apparatus as claimed in claim 1, wherein the selected combination is selected from one of the following combinations: a combination in which the number of units of each denomination is determined according to said priority, and combinations in which the number of units of at least one of the denominations (excluding the lowest denomination) is one less than that determined according to priority in which case lower denomination units are then allocated according to priority and (except for the lowest denomination) one less than determined by priority.

5. Apparatus as claimed in claim 1, wherein the selection is performed such that the combination which comprises the fewest number of money units is selected.

6. Apparatus as claimed in claim 1, wherein the apparatus is also operable to determine different combinations of monetary units which in total substantially correspond, but are not equal, to the dispensing amount.

7. Apparatus as claimed in claim 6, wherein the apparatus is operable for particular dispensing operations, depending on the desired amount and the available monetary units, to determine only combinations which do not equal the dispensing amount, the selection in these circumstances being performed in such a manner that a combination which in total is closest to, but less than, the dispensing amount is selected.

8. Apparatus as claimed in claim 1, in which the apparatus is operable to determine the combinations by performing the following steps in the named order:

(a) determining a first combination on the basis of said priority;

(b) establishing a residual dispense value by summing the value of a single monetary unit of a restore denomination which is greater than the lowest of the denominations in the first combination, and the total values of all coins of the first combination which have a denomination lower than the restore denomination; and (c) forming a second combination using the same units as the first combination for denominations higher than said restore denomination, using for said restore denomination the same number of units as used in said first combination minus one, and using said priority and said residual dispense value for the or each denomination lower than the restore denomination.

9. Apparatus as claimed in claim 8, the apparatus being operable to form a third combination by repeating steps (b) and (c), substituting the second combination for the first combination and using a restore denomination lower than the one used to form the second combination.

10. Apparatus as claimed in claim 8, the apparatus being operable to repeat steps (b) and (c) to form additional second combinations, using progressively higher restore denominations.

11. Apparatus as claimed in claim 10, the apparatus being operable to determine third combinations by, for each of the second combinations, repeating steps (b) and (c), substituting the respective second combination for the first combination and using a restore denomination which is lower that the restore denomination used to form the respective second combination.

12. Apparatus as claimed in claim 10, the apparatus being operable to terminate the forming of combinations in response to determining that all appropriate combinations have been formed which use, for the highest denomination used in the first combination, one less than the number of units used to form the first combination.

13. Apparatus as claimed in claim 1, the apparatus being operable to determine when there is no combination which in total equals the dispensing amount, and to provide in response thereto an indication to a user that the desired amount cannot be dispensed.

14. Apparatus as claimed in claim 1, the apparatus being operable to determine during a dispensing operation that a monetary unit required for the selected combination is not available, and in response thereto to determine a revised dispensing amount representing the remaining amount desired to be dispensed, and then select a new combination of monetary units to permit dispensing of the revised dispensing amount.

15. Apparatus as claimed in claim 1, the apparatus being operable to retain units not selected for dispensing in such a way as to permit their dispensing in a subsequent dispensing operation.

16. The apparatus of claim 1, wherein said combining means further comprises means for generating said different combinations by performing calculations using the values of the units forming each said different combination.

17. Apparatus for dispensing money in the form of units having a plurality of denominations, the apparatus having store means for storing the units, dispensing means for dispensing the units from the store means, and a control apparatus for controlling the dispense means, the control apparatus being operable to: (i) determine a dispensing amount representing a desired amount to be dispensed; (ii) determine different combinations of monetary units which in total equal the dispensing amount; (iii) compare said different combinations; and (iv) select one of said combinations for use when dispensing, wherein one combination is formed by giving priority to units in order of denomination, with the highest denomination having the highest priority, and a further combination is formed using the same priority except that the number of units of one denomination, which is higher than the lowest denomination, is equal to one less than that determined according to priority.

18. An apparatus as claimed in claim 17, wherein the apparatus is used in a vending machine having means for accumulating a credit value, means for permitting a user to select a vend, and means for calculating the difference between the credit value and a price corresponding to the vend in order to determine a dispensing amount to be dispensed as change, and wherein the apparatus dispenses said change.

19. The apparatus of claim 17, wherein said control apparatus is further operable to generate said different combinations by performing calculations using the values of the units forming each said different combination.

20. A method of controlling the dispensing of money in the form of units having a plurality of denominations, the method comprising:

(i) determining a dispensing amount representing a desired amount to be dispensed;

(ii) determining different combinations of monetary units which in total equal the dispensing amount;

(iii) comparing said different combinations; and (iv) selecting one of said combinations for use when dispensing;

wherein one combination is formed by giving priority to units in order of denomination, with the highest denomination having the highest priority, and a further combination is formed using the same priority except that the number of units of one denomination, which is higher than the lowest denomination, is equal to one less than that determined according to priority.

21. A method as claimed in claim 20, wherein a plurality of further combinations are formed, each using the same priority except that in each case the number of units of a respective denomination is one less than determined according to priority.

22. A method as claimed in claim 21, including the step of determining further combinations in each of which the number of units of each of a plurality of denominations is one less than determined according to priority.

23. A method as claimed in claim 20, wherein the selected combination is selected from one of the following combinations: a combination in which the number of units of each denomination is determined according to said priority, and combinations in which the number of units of at least one of the denominations (excluding the lowest denomination) is one less than that determined according to priority in which case lower denomination units are then allocated according to priority and (except for the lowest denomination) one less than determined by priority.

24. A method as claimed in any one of claims 20 to 23, including the step of retaining units not selected for dispensing in such a way as to permit their dispensing in a subsequent dispensing operation.

25. The method of claim 20, wherein said determining different combinations steps further comprises the step of generating said different combinations by performing calculations using the values of the units forming each said different combination.

* * * * *